US006186892B1

(12) United States Patent
Frank et al.

(10) Patent No.: US 6,186,892 B1
(45) Date of Patent: Feb. 13, 2001

(54) BINGO GAME FOR USE ON THE INTERACTIVE COMMUNICATION NETWORK WHICH RELIES UPON PROBABILITIES FOR WINNING

(76) Inventors: Alan Frank; Jane M. McIntyre, both of 2120 Greentree Rd. Ste. 301-E, Pittsburgh, PA (US) 15220

( * ) Notice: Under 35 U.S.C. 154(b), the term of this patent shall be extended for 0 days.

(21) Appl. No.: 08/951,334

(22) Filed: Oct. 16, 1997

(51) Int. Cl.[7] ..... A63F 13/00; A63F 9/24; G06F 17/00; G06F 19/00

(52) U.S. Cl. ..... 463/19; 463/16; 463/17; 463/18; 273/269; 273/237

(58) Field of Search ..... 463/19, 16, 17, 463/18, 22, 25; 273/269, 237

(56) References Cited

U.S. PATENT DOCUMENTS

| | | | | |
|---|---|---|---|---|
| 4,080,596 | * | 3/1978 | Keck et al. | 340/323 X |
| 4,312,511 | * | 1/1982 | Jullien | 273/237 X |
| 4,332,389 | * | 6/1982 | Loy, Jr. et al. | 273/237 X |
| 4,436,308 | * | 3/1984 | Rose et al. | 273/237 X |
| 4,651,995 | * | 3/1987 | Henkel | 273/237 X |
| 4,937,853 | * | 6/1990 | Brule et al. | 379/96 X |
| 5,011,157 | * | 4/1991 | Lovell, Sr. et al. | 273/238 X |
| 5,072,381 | | 12/1991 | Richardson et al. | 364/410 |
| 5,102,135 | * | 4/1992 | Addiechi | 273/142 E X |
| 5,265,880 | | 11/1993 | Maksymec | 273/269 |
| 5,327,485 | * | 7/1994 | Leaden | 379/95 X |
| 5,417,424 | * | 5/1995 | Snowden et al. | 273/138 A X |
| 5,518,253 | | 5/1996 | Pocock et al. | 273/439 |
| 5,569,083 | | 10/1996 | Fioretti | 463/19 |
| 5,613,680 | * | 3/1997 | Groves et al. | 273/128.2 X |
| 5,657,991 | | 8/1997 | Camarato | 273/269 |
| 5,711,707 | * | 1/1998 | Zoccole et al. | 463/35 X |
| 5,718,631 | * | 2/1998 | Invencion | 463/19 |
| 5,743,526 | * | 4/1998 | Inoue | 273/144 X |
| 5,755,619 | * | 5/1998 | Matsumoto et al. | 463/19 X |

* cited by examiner

*Primary Examiner*—Joe H. Cheng
*Assistant Examiner*—Binh-An Nguyen
(74) *Attorney, Agent, or Firm*—Dennison, Scheiner, Schultz & Wakeman

(57) ABSTRACT

A method and apparatus for playing bingo having a prize structure which is based upon the true mathematical probabilities of forming pre-announced winning bingo patterns after each random bingo number is drawn and telecasting the mechanical random number generating process live, while simultaneously transceiving information interactively over the telephone or a global communications network, for example, the Internet. In this game, players are not required to assemble in one place. An unlimited number of players can participate simultaneously from different remote locations without changing any individual player's chances of winning.

13 Claims, 4 Drawing Sheets

ODDS OF FORMING WINNING BINGO PATTERNS AFTER SUCCESSIVE RANDOM DRAWINGS, ASSUMING FOUR OUT OF FIVE SPACES IN A ROW OR COLUMN OR ON A DIAGONAL AND FOUR CORNERS CONSTITUTE A WINNING BINGO PATTERN, AND ASSUMING NO FIVE CARD BINGOS AND NO FREE SPACE.

| | BINGO PATTERNS FORMED PER MILLION GAMES PLAYED |
|---|---|
| AFTER THE FOURTH NUMBER IS DRAWN | 50.9 |
| AFTER THE FIFTH NUMBER IS DRAWN | 229 |
| AFTER THE SIXTH NUMBER IS DRAWN | 760 |
| AFTER THE SEVENTH NUMBER IS DRAWN | 1,761 |
| AFTER THE EIGHTH NUMBER IS DRAWN | 3,391 |
| AFTER THE NINTH NUMBER IS DRAWN | 5,916 |
| AFTER THE TENTH NUMBER IS DRAWN | 9,721 |

| B | I | N | G | O | | B | I | N | G | O | | B | I | N | G | O |
|---|---|---|---|---|---|---|---|---|---|---|---|---|---|---|---|---|
| | | | | | | | | | | | | | | | | |
| | | | | | | | | | | | | | | | | |
| | | FREE | | | | | | FREE | | | | | | FREE | | |
| | | | | | | | | | | | | | | | | |
| | | | | | | | | | | | | | | | | |
| B | I | N | G | O | | B | I | N | G | O | | B | I | N | G | O |
| | | | | | | | | | | | | | | | | |
| | | | | | | | | | | | | | | | | |
| | | FREE | | | | | | FREE | | | | | | FREE | | |
| | | | | | | | | | | | | | | | | |
| | | | | | | | | | | | | | | | | |
| B | I | N | G | O | | B | I | N | G | O | | B | I | N | G | O |
| | | | | | | | | | | | | | | | | |
| | | | | | | | | | | | | | | | | |
| | | FREE | | | | | | FREE | | | | | | FREE | | |
| | | | | | | | | | | | | | | | | |
| | | | | | | | | | | | | | | | | |

FIG. 1

FIG. 2

| CARDS 001 to 003 | | | | | | CARDS 004 to 006 | | | | | | CARDS 007 to 009 | | | | |
|---|---|---|---|---|---|---|---|---|---|---|---|---|---|---|---|---|
| B | I | N | G | O | | B | I | N | G | O | | B | I | N | G | O |
| 3 | 20 | 39 | 60 | 67 | | 7 | 29 | 32 | 58 | 68 | | 15 | 18 | 43 | 47 | 73 |
| 5 | 18 | 42 | 56 | 71 | | 5 | 21 | 35 | 55 | 62 | | 14 | 16 | 37 | 57 | 66 |
| 9 | 17 | 41 | 55 | 68 | | 2 | 28 | 41 | 56 | 61 | | 9 | 22 | 45 | 52 | 70 |
| 12 | 22 | 43 | 53 | 73 | | 4 | 30 | 45 | 52 | 71 | | 12 | 25 | 36 | 54 | 62 |
| 11 | 16 | 44 | 51 | 69 | | 14 | 18 | 43 | 60 | 70 | | 5 | 21 | 31 | 55 | 71 |
| B | I | N | G | O | | B | I | N | G | O | | B | I | N | G | O |
| 15 | 19 | 34 | 46 | 75 | | 10 | 25 | 37 | 54 | 74 | | 6 | 30 | 44 | 59 | 61 |
| 13 | 30 | 31 | 59 | 63 | | 12 | 20 | 36 | 59 | 73 | | 8 | 19 | 33 | 50 | 64 |
| 4 | 24 | 45 | 52 | 72 | | 13 | 16 | 31 | 48 | 63 | | 1 | 20 | 30 | 51 | 65 |
| 1 | 28 | 36 | 58 | 74 | | 3 | 22 | 38 | 57 | 67 | | 3 | 17 | 35 | 56 | 63 |
| 14 | 26 | 38 | 54 | 65 | | 8 | 19 | 42 | 50 | 69 | | 7 | 28 | 38 | 48 | 74 |
| B | I | N | G | O | | B | I | N | G | O | | B | I | N | G | O |
| 10 | 25 | 37 | 57 | 62 | | 11 | 23 | 40 | 51 | 64 | | 4 | 24 | 32 | 58 | 72 |
| 8 | 21 | 32 | 50 | 64 | | 1 | 26 | 39 | 49 | 66 | | 10 | 29 | 40 | 49 | 67 |
| 6 | 23 | 40 | 47 | 61 | | 6 | 27 | 44 | 46 | 75 | | 13 | 26 | 34 | 46 | 68 |
| 7 | 27 | 33 | 49 | 66 | | 15 | 17 | 34 | 53 | 65 | | 2 | 27 | 42 | 53 | 69 |
| 2 | 24 | 35 | 48 | 70 | | 9 | 24 | 33 | 47 | 72 | | 11 | 23 | 41 | 60 | 75 |

SHEET NUMBER _____ GAME NUMBERS _____ DATE _____ BET AMOUNT _____

ODDS OF FORMING WINNING BINGO PATTERNS AFTER SUCCESSIVE RANDOM DRAWINGS, ASSUMING FOUR OUT OF FIVE SPACES IN A ROW OR COLUMN OR ON A DIAGONAL AND FOUR CORNERS CONSTITUTE A WINNING BINGO PATTERN, AND ASSUMING NO FIVE CARD BINGOS AND NO FREE SPACE.

| | BINGO PATTERNS FORMED PER MILLION GAMES PLAYED |
|---|---|
| AFTER THE FOURTH NUMBER IS DRAWN | 50.9 |
| AFTER THE FIFTH NUMBER IS DRAWN | 229 |
| AFTER THE SIXTH NUMBER IS DRAWN | 760 |
| AFTER THE SEVENTH NUMBER IS DRAWN | 1,761 |
| AFTER THE EIGHTH NUMBER IS DRAWN | 3,391 |
| AFTER THE NINTH NUMBER IS DRAWN | 5,916 |
| AFTER THE TENTH NUMBER IS DRAWN | 9,721 |

FIG. 3

BINGO GAME FOR USE ON THE INTERACTIVE COMMUNICATION NETWORK WHICH RELIES UPON PROBABILITIES FOR WINNING

FIELD OF THE INVENTION

This invention relates generally to a method and apparatus for playing bingo that relies upon two novel concepts: a prize structure which is based upon the true mathematical probabilities of forming preannounced winning bingo patterns after each random bingo number is drawn; and, telecasting the mechanical random number generating process live, while simultaneously transceiving information interactively over the telephone or a global communications network, for example, the Internet.

In using this bingo game, players are not required to assemble in one place. An unlimited number of players can participate simultaneously from different remote locations without changing any individual player's chances of winning. Also, the game ends after drawing a pre-announced quantity of randomly selected bingo numbers. More than one player can win a prize after each random number is drawn. The prizes vaty in amounts within the same game. Additionally, players are able to create and use their own personalized bingo cards.

A bingo game with the foregoing type of prize structure has special appeal to players who are unable to get to a bingo playing location, or prefer not to assemble in a common bingo playing location.

DESCRIPTION OF THE RELATED ART

PRIOR ART

U.S. Pat. No. 5,072,381 (Richardson, et al) shows an electronic gaming system which includes a system base station and a plurality of gaming boards.

U.S. Pat. No. 5,265,880 (Maksymec) teaches a long duration bingo game wherein a fixed number of bingo numbers are drawn from the pool of numbers and winning cards are paid off at a minimum of 1,000 times the purchase price.

U.S. Pat. No. 5,518,253 (Pocock, et al) shows a televised bingo game system wherein players enter by telephone and billing is provided a a '900' number. A computer system plays the selected bingo balls against all entered bingo cards.

U.S. Pat. No. 5,569,083 (Fioretti) demonstrates a method of playing bingo over a wide geographic area, in real time and on an interactive basis.

U.S. Pat. No. 5,657,991 (Camarato) shows an interactive bingo-like game and method played electronically

BACKGROUND OF THE INVENTION

The current state of the prior art in the field of "Bingo-type" games is significant, but easily distinguished from the present invention. The traditional game of bingo is played in the following manner. Individual participants use different cards. The cards are randomly generated such that no two are the same, within the specific game being played. The card columns are labeled "B", "I", "N", "G", and "O". The five rows of the card are unlabeled, but partitioned such that the game card has individual squares, each containing a number. A "FREE" space may be assigned a card which allows a tile to be placed thereon when the games begins.

The caller of the game randomly draws a number and column, usually selecting from a pool of balls or tiles which have random assignments labeled on them. If the number called is associated with the same number in the designated column of the player's card, the game participant places a tile in the square. The game is won by the game participant who first places a tile in each square comprising a row, column or diagonal across the respective board.

There has developed many variations of the above traditional game. The current art of bingo does not include a game form which bases winning not on chance, but on mathematical probability. In existing bingo games, the players assemble in one location, purchase their bingo cards and hope that the randomly drawn numbers form winning bingo patterns on one or more of their own bingo cards before forming winning patterns on another player's card. In each game, only a single player who was lucky enough to possess the card that contained the winning pattern, wins a prize. When the first winning pattern is formed on any card, the game ends.

There are shortcomings in current formats of playing bingo. As the quantity of cards in the game increases, each player's chance of winning decreases. Also, the game's integrity is in question because the opportunity for cheating exists. For example, a dishonest player who is a confederate of the dishonest operator can tamper with the numbers on his or her card during a game. When the dishonest player calls "bingo", the dishonest operator overlooks the tampering on the winning card while verifying it, and pays the dishonest player. The dishonest player covertly divides the winnings with the dishonest operator. The legitimate players are thereby deprived of a fair opportunity to win.

Additionally, all current versions of bingo require players to select from a group of pre-printed bingo cards prior to beginning play. There is no opportunity for a player to create his or her own unique and personal bingo card. Personalized cards would help to increase player confidence in the integrity of the game.

Existing bingo games played over the Global communications network, for example the Internet, are similarly deficient. They involve a common web site to which all players are interactively connected. The first player to obtain a bingo signals the common web site, and the game ends. As in a bingo hall, there is usually only one winning card per game. Again, the element of doubt exists because it is impossible to verify the legitimacy of the winners and the integrity of the game. A dishonest web site operator can easily verify a non-legitimate wining card.

Many forms of gaming on the telephone and on the Global communications network, for example, the Internet, depend upon the outcome of random number generation. A major shortcoming of global communications network and telephone gaming is the inability of bettors to observe the mechanical random number generating process live in high quality, full screen, real time video. In existing global communications network gaming operations, the results of random number generation are made available for viewing on players' computer monitors by posting bland text spelling out the outcomes. But because of limitations in current technology, computers and monitors are unable to present live, full screen, high quality displays of the random number generating process.

The present invention overcomes this shortcoming by using a variety of broadcasting mediums, including television and telephone, simultaneously, thereby enabling players who prefer to play bingo without sitting in a bingo hall, to maintain interactive communications with the bingo operator by telephone or on the Global communications network, for example the Internet while simultaneously observing the mechanical equipment, live, on conventional television, as it generates random bingo numbers.

A need, therefore, exists for a method of playing bingo: which enables players to win based upon the true mathematical probabilities, regardless of the quantity of other players or their success; which can accommodate an unlimited number of players without altering a player's chances of winning and without altering the prize structure; which enables players to play privately, which enables players to create their own personal bingo cards; which enables more than one player to win differing prizes in each game; and which enables the players to observe high quality, live, full screen displays of the mechanical equipment as it generates random numbers.

SUMMARY OF THE INVENTION

It is the object of the present invention, therefore, to overcome the aforesaid deficiencies and to provide all prospective bingo players with the described benefits.

It is the primary object of the present invention to provide a bingo game wherein the chances of winning are determined by mathematical probabilities.

It is a second object of the present invention to provide a bingo game wherein the player are able to assign their own numbers to their respective cards, thereby determining their own pattern for winning and increasing the confidence in the integrity of the game.

It is a fourth object of the present invention to conduct a bingo game wherein the chances of winning is not affected by the number of player.

It is a third object of the present invention to allow the interactive conduct of bingo over a global communications network utilizing television, which is interactive with the network, to provide high resolution feedback to the players on the network.

In the present invention, prospective players are supplied with blank bingo card templates which they obtain either by mail or from a central gaming system by means of computer printers. On each card there are five vertical columns, each headed by the familiar letters, B-I-N-G-O, and five horizontal rows, creating a checkerboard pattern of twenty five blank spaces. As will be explained, the number of rows and columns may vary, but the invention as herein described is not modified by this variable feature.

Players individually insert their preferred numbers into the blank spaces on their respective bingo card templates. The numbers must comply with the numerical limits of each column. In the version of bingo which is commonly played in the United States, the limits are: Numbers 1–15 for the "B" column; Numbers 16–30 for the "I" column; Numbers 31–45 for the "W" column; Numbers 46–60 for the "G" column; and Numbers 61–75 for the "O" column. In other countries, the starting pool is 90 numbers, instead of 75. Each column, therefore, can contains 18 possible different numbers, instead of 15. Players can also use existing pre-numbered cards. Each card, whether pre-numbered or personally created, is assigned a unique identification number, and must be registered into a computer program before it may be approved and used.

Each game is assigned a unique, dated, and timed, sequential identification number. Prior to the start of each game, the operator announces the exact quantity of random numbers that will be drawn from the starting pool of 75 possible numbers, and describes the winning patterns required for the upcoming game. The operator also announces the prize structure. For purposes of this embodiment, it is assumed that the prizes are monetary.

Prior to the start of any game or series of games, players notify the operator by telephonic intercommunication of the amount they desire to wager on each card, the game numbers and their card numbers. Players may play as many cards as they like.

The amounts of the prizes to be awarded are directly proportional to the amount wagered. Additionally, as the quantity of random bingo numbers selected increases, the prize amounts decrease and the quantity of winners increases. The operator's overall percentage of retention is constant and is openly disclosed, along with the prize structure, prior to the commencement of play. All of the foregoing information is made available to prospective players on information displayed on both television and computer monitors.

In the typical game, any quantity of random bingo numbers ranging from four to eight will be drawn. The game ends after the final draw regardless of the number of winning bingo patterns that have been formed. In games where only four random bingo numbers are drawn, the prize amount will be at a maximum. In games where eight random bingo numbers are drawn, the prize amounts will be at a minimum.

After the fourth number is drawn, the central computer scans all cards, and identifies those cards that contain winning patterns. After the fifth number is drawn, the computer again performs a scan and repeats the aforementioned procedure, except the amount of each prize will be substantially smaller, and more of them will be won. Likewise, after each successive random bingo number is drawn, prizes of decreasing amounts are calculated and awarded.

A random number generator that generates all of the numbers simultaneously, but identifies the generated numbers in sequential fashion, helps to increase speed of play.

All game formats will be unmistakably pre-announced by the operator. In a "four draw" game, Since there are five different winning bingo patterns possible after four numbers are drawn, (four comers, middle row, "N" column, front slash and back slash). The player's probabilities of winning that particular game are five out of 1.215 million, or one out of 243,000. All players who hold cards containing any of the winning patterns will win 90% of 243,000 (218,700) multiplied by the amount bet. For a bet of one penny, a player will win $2,187.00. The operator retains ten percent of all amounts wagered.

If a game is pre-announced as a "five draw" game, there will be many more winners, and accordingly, the prize amounts will be smaller. The amount won is immediately credited to the player's credit card or account, even if the player does not mark his or her bingo card properly.

In an alternative embodiment of the invention, stand alone video games programmed with the aforesaid prize structure enable people to play bingo privately. Data received from interconnected random number generating equipment combines with the prize structure program, thereby determining whether a winning pattern has been formed, whether the player pre-selected a winning card, and if so, how much was wagered, and then calculates the appropriate prize amount.

In other alternative embodiments of the invention, live television broadcasts of the mechanical random number generating equipment, such as roulette wheels, bouncing lottery balls, and rolling dice are used to enhance the credibility and pleasure of the games.

BRIEF DESCRIPTION OF THE DRAWINGS

FIG. 1 is a sample blank template for nine un-numbered bingo cards.

FIG. 2 is a sample template containing nine pre-numbered bingo cards.

FIG. 3 is a table of the actual mathematical odds of obtaining a winning bingo pattern as successive random numbers are drawn from a staring pool of 75 numbers.

DETAILED DESCRIPTION OF PREFERRED EMBODIMENTS

Figure 4:
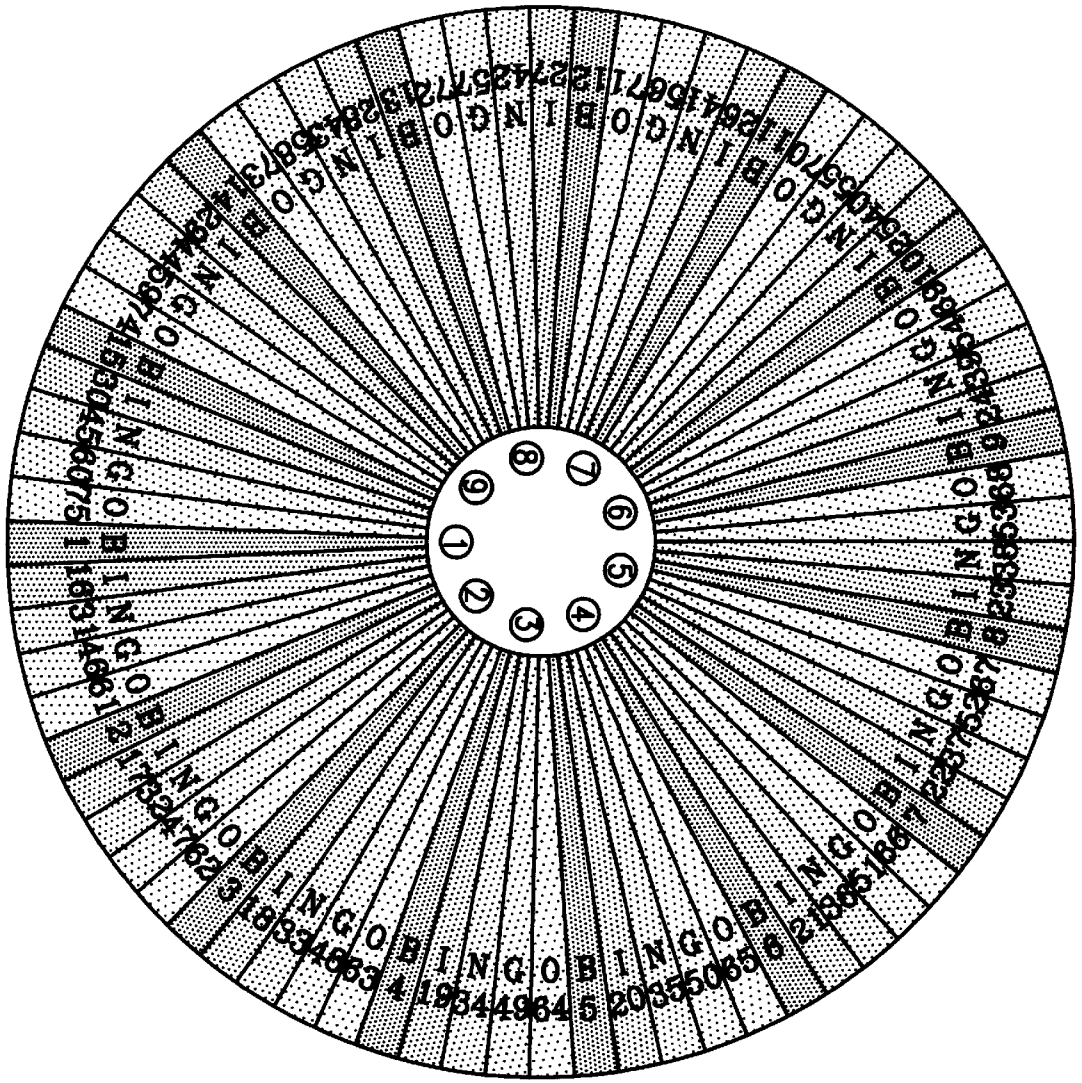
FIG. 4 is a drawing of a random number generator for use in an embodiment of this bingo game which shows the pattern of numbers on a disk and a plurality of balls for use thereon.

The invention will now be described in detail in relation to a preferred embodiment and implementation thereof which is exemplary in nature and descriptively specific as disclosed. As is customary, it will be understood that no limitation of the scope of the invention is thereby intended, and that the invention encompasses such alterations and further modifications in the illustrated device, and such further applications of the principles of the invention illustrated herein, as would normally occur to persons skilled in the art to which the invention relates.

A player obtained the blank card series as shown in FIG. 1. That player then completes the card, as in FIG. 2, selecting his own series of numbers for each card. The card is indexed and registered with the central gaming system, and play is then commenced.

The player can wager one penny on each card for a specified set of 100 games. The total cost would be $9.00. Since each card and each sheet have a unique identification number, the wagering process is simplified. A sample game would be played as follows:

The operator pre-announces the winning patterns to be all four comer spaces plus: four out of any five spaces in any horizontal row plus; four out of any five spaces in any vertical column, plus four out of any five spaces on either diagonal line, and no free space. The operator also pre-announces that only four numbers will be drawn.

As then reflected in FIG. 2, card 001 (upper left comer), for the sample game wherein one of the winning patterns happens to be B-12, N-43, G-53, 0-73, the player would win $180.00 for the four out of five pattern shown thereon.

For this particular game format, and referring to FIG. 3, there are a total of 61 possible four space patterns that would constitute winners. On a 25 space bingo card, there are a total of 1.215 million possible four space combinations. The probabilities of forming such a four space winning pattern after the first four random numbers are drawn are about one out of 20,000.

Assuming a ten percent retention by the operator, all cards that contain one of the 61 patterns after four numbers are drawn would earn a prize of 18,000 multiplied by the amount bet. For a bet of one penny, a cardholder of one winning pattern would receive a prize of $180.00. If a player bet one dollar per card and his or her sheet contained two wing patterns, that player would also receive a prize, but the amount would be $36,000.00. Since all cards currently in play are registered into the computer before play starts, the possibility of tampering and cheating is eliminated.

There is a super jackpot version which may be played. If the operator announces that only the "four comer" pattern will constitute a bingo, and only four numbers will be drawn, the probabilities of the occurrence of that single combination are one out of 1.215 million. With a ten percent operator retention, all winning cards would receive a prize of 1.093 million to one. A bet of one penny would earn a prize of $10,930.00 for any player whose card contained a four corner bingo after four numbers were drawn. Referring to FIG.2, card 002 (upper center), if the four numbers called were B-7, B-14, 0-68 and 0-70, the player would win $10,930.00. By means of further example, and referring to FIG. 2., for cards 003 (upper right) and 006 (middle right), if the numbers called were B-15, B-14, B-8, B-9 and B-12, the player would win $18.00.

The next example again assumes an operator retention of ten percent (called a retention percentage), and 61 winning bingo patterns. However, this time the operator pre-announces a "five draw" game, which means that the game ends when five random numbers have been drawn, regardless of the number of winning cards.

As described, above, the chances of a single card containing any one of 61 winning patterns after four random numbers have been drawn is about one in about 20,000. After five random numbers have been drawn, there are 366 possibilities of forming a four space winning pattern.

For this example, the prize structure of the instant invention sets up two equal prize divisions, one division after the fourth random number is drawn and another division after the fifth random number is drawn. The prize structure of the instant invention retains the basic formula of awarding prizes totaling 18,000:1 for the bingo version that offers 61 four-space, winning patterns.

Accordingly, after the fourth random number is drawn, a prize of 9,000:1 is awarded to all winning cards. After the fifth random number is drawn, a prize of 1,800:1 is awarded to all winning cards. According to mathematical probabilities, there will probably be five times more winning patterns formed after the fifth random number is drawn than were formed after the fourth random number was drawn.

After the fourth random number has been drawn, a bet of one penny would earn a prize of $90.00 for each card that contained a winning pattern. After the next (fifth) random number has been drawn, a bet of one penny would earn a prize of $18.00 for each card that contained a winning pattern.

For a "six draw" game, with the same 61 winning patterns, three equal prize divisions are established. The first division covers the 61 winning cards after the fourth draw. The next division covers the 305 winning cards after the fifth draw. The last division covers the 915 winning cards after the sixth draw. The prizes to be awarded are $60.00, $12.00 and $4.00 per penny per card respectively.

In all versions, a computer program performs a scan after each random number is drawn (beginning with the fourth and continuing until all of the pre-announced quantity of numbers has been drawn), to determine if any registered card contains a winning pattern. If a winning patterns exist, all the accounts of all the winning cardholder are immediately credited with the appropriate amounts, depending upon the amount bet on each card and the quantity of random numbers which were drawn before the winning pattern was formed.

The game is conducive to the use of a variety of means for generating random numbers. For example, the numbers may be selected by computer or by drawing numbers from a container. In a preferred embodiment of the present invention, a spinning wheel, similar to a roulette wheel, and spherical balls, are used. This means is very adaptable to the use as part of a system which can be viewed on conventional television, by private video-teleconferencing, on public cable channels, and on a global communications network, like the Internet, and is, therefore, appropriate for the present invention. In this means, a plurality of balls are used, each representing a "draw" for purposes of placing bets and computing prizes. The balls are numbered sequentially to identify which "draw" is being played. In a four draw game, balls one through four are used, for instance. Also employed is a spinning wheel, shown in FIG. 4. The spinning motion causes each of the balls to settle into a pre-numbered pocket During game play, the balls are placed onto the spinning wheel and individually seek a pocket. As many random numbers as desired may be generated. If a player gets a bingo by matching the pattern formed by the bingo numbers generated by the one ball, the two ball, the three ball and the four ball, the player wins a prize of 3929 multiplied by the retention percentage. If the bingo occurs after the fifth draw, the prize is 873 multiplied by the retention percentage.

The mechanical random number generating process will be televised live on conventional television, by private video-teleconferencing, on public cable channels and on the Internet. Bingo players are able to view the live drawings on their television sets and computer monitors, and are able to interact with the bingo operator either by audio/telephone or by connecting to the Internet. Simultaneously with the generating and telecasting of the random bingo numbers, a scoreboard displays the results of each game.

We claim:

1. A method for providing bingo among services to a plurality of player participants, comprising the steps of:

(a) assigning a bingo operator for a bingo game;

(b) providing a means for exchanging bingo playing information between said player participants and said bingo operator;

(c) making available to said player participants a plurality of bingo cards each having a unique numerical bingo pattern and each being identifiable by discreet indicia;

(d) requiring each of said player participants, before the start of each bingo game, to select and identify from said plurality of bingo cards those cards which each of said player participants is entering into play for a particular bingo game and;

(e) specifying, before the start of each bingo game, described patterns which, when formed upon a bingo card, constitute wining patterns;

(f) ascertaining and recording, before the start of each bingo game, the discreet indicia of each of said bingo cards to be played by each player participant;

(g) ascertaining, before the start of each game, a quantity of random numbers which are to be drawn in each game for each player, whereby said game will end when said quantity of random numbers has been drawn, without regard to the number of winning bingo patterns that have been formed;

(h) ascertaining, before the start of each game, a prize paying structure which includes a plurality of prizes payable in the same game, and wherein:

(1) the amount of each of said prizes is dependent upon said quantity of random numbers that are generated during each game for each player, prior to the forming of a winning pattern; and, (2) a player's award is independent of the quantity of cards of other player in the game being played, and are independent of the success of other players (i) generating said quantity of random numbers by a random number generating means; and, (j) awarding one of said prizes when any bingo card then in play contains any of said winning patterns.

2. A method as in claim 1 for playing bingo among a plurality of player participants, further comprising a telephone as said means for exchanging bingo playing information between said player participants and said bingo operator.

3. A method as in claim 1 for playing bingo among a plurality of player participants, further comprising voice communication in person as said means for exchanging bingo playing information between said player participants and said bingo operator.

4. A method as in claim 1 for playing bingo among a plurality of player participants, further comprising an interactive computer network as said means for exchanging bingo playing information between said player participants and said bingo operator.

5. A method of providing a bingo game comprising the steps of:

providing a bingo operator for determining at least one winning bingo pattern;

registering at least one bingo card bearing a plurality of bingo numbers with said operator;

generating a predetermined number of random bingo numbers; and, identifying all registered bingo cards on which the generated random bingo numbers form one of said at least one winning bingo pattern and, awarding the holder of the winning bingo card an award wherein the amount of said award is independent of the number of registered bingo cards on which a winning bingo pattern is formed.

6. The method of claim 5 including the additional steps of:

assigning an ordinal number to each of said random bingo numbers;

determining for each bingo card identified as having a winning bingo pattern a winning ordinal number equal to the ordinal number of the random number that produced said winning bingo pattern on said card; and, basing said award on the probability of obtaining a winning bingo pattern after the winning ordinal number of random numbers is generated.

7. The method of claim 6 wherein the step of registering at least one bingo card with a bingo operator comprises the step of transmitting information concerning said at least one bingo card over a telecommunications network from a first location to said bingo operator.

8. The method of claim 7 wherein the step of generating a predetermined number of random bingo numbers comprises the steps of:

providing at least one draw marker object; providing a plurality of pockets each marked with a bingo number for receiving a single one of said draw marker objects; releasing said at least one draw marker object such that it comes to rest in a random one of said pockets; and, setting one of said random bingo numbers equal to the bingo number on the pocket in which said draw marker object lands.

9. The method of claim 7 wherein said at least one draw marker object comprises a plurality of sequentially numbered balls and said plurality of pockets are arranged around the circumference of a spinning disk.

10. The method of claim 7 wherein the step of identifying all registered bingo cards on which the generated random bingo numbers form a winning bingo pattern comprises the step of sending information from said bingo operator to said first location over a telecommunications network.

11. The method of claim 10 wherein said bingo cards are selected from a preprinted supply of bingo cards.

12. An apparatus for enabling at least one individual to play bingo on at least one bingo card associated with said at least one individual comprising:

a random number generator;

a data processor having associated memory means for storing a winning bingo pattern; and, at least one bingo card;

wherein information concerning the identity of said at least one bingo card is stored in said memory means, a predetermined number of random numbers are received in said data processor from said random number generator, and all of said at least one bingo card on which the received random bingo numbers form a winning bingo pattern are determined by said data processor and wherein an ordinal number is associated with each of said random bingo numbers, a winning ordinal number equal to the ordinal number of the random number that produced said winning bingo pattern on said card is specified for each bingo card determined to have a winning bingo pattern, and, an award based solely on the probability of obtaining a winning bingo pattern after the winning ordinal number of random numbers is generated is given to a holder of the winning bingo card.

13. A method for enabling at least one individual to play bingo on at least one bingo card associated with the individual comprising the steps of:

providing a bingo operator for determining at least one winning bingo pattern;

registering at least one bingo card bearing a plurality of bingo numbers with said operator;

predetermining a number of random bingo numbers to be selected in said game;

selecting a first random bingo number;

identifying all registered bingo cards on which said first random bingo number forms a winning bingo pattern and awarding a first prize to the individual associated with each bingo card on which said first random bingo number forms a winning bingo pattern wherein said first prize is independent of the number of bingo cards on which said first random bingo number forms a winning bingo pattern;

selecting a subsequent random bingo number;

identifying all registered bingo cards on which said first random bingo number and said subsequent random bingo number together form a winning bingo pattern and awarding a subsequent prize to the individual associated with each bingo card on which said first random bingo number and said subsequent random bingo number form a winning bingo pattern wherein said subsequent prize is independent of the number of bingo cards on which said subsequent random bingo number forms a winning bingo pattern;

selecting additional random bingo numbers until said determined number of random bingo numbers has been selected; and, after each additional random bingo number is selected, identifying all registered bingo cards on which the last-selected additional random bingo number together with said first and said subsequent random bingo numbers form a winning bingo pattern and awarding an additional prize to the individual associated with each bingo card on which said first random bingo number, subsequent random bingo number, and the last-selected additional random bingo numbers form a winning bingo pattern;

wherein the amount of said prize decreases as the number of random bingo numbers selected increases.

* * * * *